US008517056B2

(12) United States Patent
Cullin

(10) Patent No.: US 8,517,056 B2
(45) Date of Patent: Aug. 27, 2013

(54) FLUID REGULATOR

(75) Inventor: Peter Cullin, Clifton Beach (AU)

(73) Assignee: Cullin Innovation Pty Ltd (AU)

( * ) Notice: Subject to any disclaimer, the term of this patent is extended or adjusted under 35 U.S.C. 154(b) by 825 days.

(21) Appl. No.: 12/327,054

(22) Filed: Dec. 3, 2008

(65) Prior Publication Data

US 2009/0101212 A1 Apr. 23, 2009

Related U.S. Application Data

(63) Continuation-in-part of application No. PCT/AU2007/ 000782, filed on Jun. 4, 2007.

(30) Foreign Application Priority Data

Jun. 5, 2006 (AU) ..... 2006903037

(51) Int. Cl.
*B01F 5/04* (2006.01)

(52) U.S. Cl.
USPC ..... 137/894; 137/337; 137/888; 137/892

(58) Field of Classification Search
USPC ..... 137/337, 888, 891, 892, 893, 894, 137/625.41, 625.46, 625.47; 239/318, 317
See application file for complete search history.

(56) References Cited

U.S. PATENT DOCUMENTS

| | | | | |
|---|---|---|---|---|
| 1,887,836 | A * | 11/1932 | Faber | 137/565.35 |
| 3,445,067 | A * | 5/1969 | Sheldall | 239/318 |
| 3,454,229 | A * | 7/1969 | Armond | 239/317 |
| 4,160,461 | A | 7/1979 | Vataru et al. | |
| 4,673,006 | A * | 6/1987 | Speck | 141/1 |
| 4,714,092 | A * | 12/1987 | Sanders | 137/894 |
| 5,794,643 | A | 8/1998 | Brice | |
| 5,823,441 | A | 10/1998 | Nicholson | |
| 5,957,379 | A * | 9/1999 | McMorrow et al. | 239/10 |
| 6,378,785 | B1 * | 4/2002 | Dodd | 239/318 |
| 2003/0137897 | A1 * | 7/2003 | Whiteley | 366/163.2 |

OTHER PUBLICATIONS

International Search Report PCT/AU2007/000782; Dated Aug. 30, 2007.

* cited by examiner

*Primary Examiner* — John Fox
*Assistant Examiner* — Kevin Murphy
(74) *Attorney, Agent, or Firm* — Cantor Colburn LLP

(57) ABSTRACT

A fluid regulator (1) for use as a shower water saving device, wherein an initial volume of water of a water stream at an undesired cold temperature is collected in a chamber and is reintroduced into the water stream when the stream has reached the desired temperature. Reintroduction of the initial volume of cold water is at a controlled rate such that the temperature change upon reintroduction is not significant. The fluid regulator (1) comprises a body (2), a flow passage (3) having an inlet (20) and outlet (21) for the water stream, a water collection chamber (4) in fluid communication with the flow passage (3), and a flow diverter (5) associated with the flow passage (3) and moveable between a closed position in which the water stream is directed to the collection chamber (4), and an open position in which the water stream may flow to the outlet (21) and the water in the collection chamber (4) may be drained from the collection chamber (4) to the outlet (21) by way of the flow passage (3).

7 Claims, 8 Drawing Sheets

FLUID REGULATOR

This application is a continuation in part of international application PCT/AU2007/000782 filed 4 Jun. 2007 which designated the US and additionally claims priority from Australian provisional patent application no. 2006903037 filed 5 Jun. 2006.

FIELD OF THE INVENTION

This invention broadly relates to a fluid regulator and to a method for regulating a fluid stream.

The invention has been developed primarily for use as a shower water saving device and will therefore be described in this context. It is to be appreciated, however, that the invention may have other uses.

BACKGROUND OF THE INVENTION

The need to conserve potable water is becoming more important than ever before. Many water saving initiatives have been implemented by authorities, and many different types of water saving and water efficient devices and appliances are available in the marketplace.

Approximately 10 million showers are taken daily in Australia. When a user of a shower initially turns on the hot and cold water taps, there is an appreciable lag before the water attains a useable temperature. Consequently, many liters of cold potable water are not utilized by the user and are lost to drain. Although water saving shower roses and shower heads are known, these address a different problem and do not address the problem of cold water loss.

SUMMARY OF THE INVENTION

The present inventors have now invented a fluid regulator and method of fluid regulation which, inter alia, minimize or overcome the problem of cold water loss referred to above.

According to a first aspect of the present invention, there is provided a fluid regulator for regulating the flow of a fluid stream, said regulator comprising:

- a body;
- a flow passage extending through the body and having an inlet for a fluid stream and an outlet for the fluid stream;
- a fluid collection chamber within the body in fluid communication with the flow passage; and
- a flow diverter associated with the flow passage and moveable between a closed position in which the fluid stream is directed to the collection chamber, and an open position in which the fluid stream may flow to the outlet and the fluid in the collection chamber may be drained from the collection chamber to the outlet by way of the flow passage.

Any suitable type of fluid stream may be regulated, but preferably the fluid is a liquid, such as water.

The body may be of any suitable size, shape and construction. The body may be made of any suitable material or materials, such as metal or plastics material. Preferably, the body has an upper region through which extends the flow passage and a lower region within which is located the collection chamber. The body may comprise two or more detachably connected pieces. For instance, the body may have a lid allowing ready access to the flow passage and the chamber.

The upper region of the body may be in the form of a conduit, such as a branched conduit, that provides the flow passage. Alternatively, the flow passage may be provided by internal walls of the body. The lower region may be in the form of a tank or container that provides the collection chamber. The lower region, may be, for instance, substantially rectangular or cylindrical. Depending on the type of flow diverter, however, the collection chamber could be located above the flow passage.

The flow passage may extend through the body and any region of the body in any suitable way. For instance, the flow passage may extend substantially linearly through the body and/or it may follow a convoluted path. Preferably, the flow passage has a constriction/throat located between the inlet and the outlet, and this constriction causes a Venturi effect. That is, the fluid stream passing through the constriction causes fluid to be drawn from the collection chamber into the flow passage.

The inlet and outlet may be of any suitable size, shape and construction, and may be made of any suitable material or materials, such as metal or plastics material. Preferably, the inlet has a coupling or connector attachable to a fluid supply line. Typically, the coupling or connector and the fluid supply line will each be threaded.

Likewise, the outlet may have a coupling or connector attachable to a fluid line, such as an outlet pipe or a shower rose. Preferably, the inlet is attachable to a fluid supply line downstream of a shower hot and cold water controller (mixing valves), and the outlet is attachable to a shower rose/head.

The fluid regulator may include a mount such that the body can be mounted to a wall or other fixture. Any suitable type of mount may be used, e.g. brackets.

The collection chamber may be of any suitable shape and volume. Preferably, the chamber is sized to collect between about 1-20 liters of fluid, but more preferably 1 to 5 liters. The chamber may be provided by a bladder or walls of the body. The collection chamber may be transparent or translucent, so as to allow visualisation of its contents.

The collection chamber may be in fluid communication with the flow passage in any suitable way. The regulator may comprise a chamber inlet and an outlet extending between the chamber and the flow passage. The chamber inlet and outlet may be one and the same. The chamber inlet and outlet may be provided by a passage or conduit extending from the flow passage to the chamber.

The collection chamber may have a vent for releasing air from the chamber when being filled with fluid and for introducing air into the chamber when fluid is being drained from the chamber. Any suitable type of vent may be used. In one embodiment, the vent extends from the chamber to the flow passage adjacent the outlet. In another embodiment, the vent has an outlet located in a peripheral wall of the body and has an inlet that may be positioned as required within the collection chamber, so as to control the level of fluid within the chamber.

The flow diverter may be of any suitable size, shape and construction, and may be made of any suitable material or materials. The flow diverter may be associated with the flow passage in any suitable way. The flow diverter may be integrally formed with the flow passage or not. The flow diverter may be moveable between the open and closed positions automatically or manually (eg. by hand).

The flow diverter may comprise at least one pressure sensitive or heat sensitive valve that is moveable between the open and closed positions by the fluid stream. For instance, the valve may move to the open position when the fluid stream has reached a predetermined pressure in the flow passage after the chamber has completely filled with fluid, and the valve may move to the closed position when the fluid stream pressure falls below the predetermined pressure in the flow passage.

In one embodiment, the flow diverter is a pressure sensitive jumper valve having a valve seat located within the flow passage and a valve member spring biased into engagement with the valve seat.

In another embodiment, the flow diverter comprises a pressure sensitive butterfly valve having a wing that is magnetically connected to a valve seat located within the flow passage. When the fluid stream reaches a predetermined pressure in the flow passage, then the wing moves to the open position. When the fluid stream pressure falls below the predetermined pressure in the flow passage, then the wing moves to the closed position.

In yet another embodiment, the flow diverter comprises a pressure sensitive valve having a first valve seat located in the flow passage, a second valve seat located in the chamber inlet, and a regulator valve member movable by the fluid stream between the valve seats, wherein the regulator valve member comprises:

a head for sealingly engaging the first valve seat;

a tail for sealingly engaging the second valve seat;

a stem extending between the head and tail, and having a passage extending therethrough for communicating fluid from the collection chamber to the flow passage, wherein the head is biased into engagement with the first valve seat and the regulator valve member can only sealingly engage the first or second valve seat at any one time, wherein when the head engages the first valve seat then the flow diverter is in the closed position, and when the tail engages the second valve seat then the flow diverter is in the open position and the fluid in the collection chamber may be drained via the passage in the stem.

The regulator valve member may be of any suitable size, shape and construction. Preferably, the stem extends along a longitudinal axis of the member and extends slidingly through both the first and second valve seats. The stem may have longitudinally extending grooves or ribs enabling the flow of fluid between the stem and the first and second valve seats when those valve seats have not been sealed by the head or tail.

Both the head and tail may have a disk-shaped portion so as to seal a central opening of the respective valve seat. Both the head and tail may have a seal, such as an o-ring, extending within a peripheral groove of the disk-shaped portion. The head may have a tapered end that is situated within the constriction/throat of the flow passage when the flow diverter is in the open position.

The regulator valve member may comprise a drainage tube, such as a rubber or plastic hose, extending from the tail to a base of the collection chamber. Such a tube will ensure that nearly all of the fluid will be drained from the chamber.

The head may be biased into engagement with the first valve seat in any suitable way. If the regulator valve member operates in a vertical orientation, such that the longitudinal axis of the member extends vertically, then gravity may bias the head into engagement with the first valve seat. If required, the member may be further biased by way of a spring, such as a coil spring. If the regulator valve member operates other than vertically, then a spring may bias the head into engagement with the first valve seat.

The regulator valve member may further comprise a float for ensuring that the flow diverter moves to the open position should the collection chamber fill with fluid. Any suitable type of float may be used. The float may be connected to the tail.

In yet another embodiment, the flow diverter comprises a valve member that is movable relative to the body of the regulator, the valve member containing a section of the flow passage that is in fluid communication with the fluid collection chamber. In the closed position, the valve member is orientated relative to the regulator body such that the fluid stream is directed to the collection chamber and in the open position valve member is orientated relative to the regulator body such that the fluid stream may flow to the outlet. Preferably, the section of the flow passage contained by the valve member has the constriction/throat, so as to cause a Venturi effect.

The valve member may be of any suitable size, shape and construction. For example, the valve member may be in the shape of a ball, cylinder or disc. Movement of the valve member may be achieved in any suitable way. For example the valve member may be slid or rotated between the closed and open positions. Preferably, the valve member is a ball valve that is rotatable between the open and closed positions.

The flow diverter may further comprise a valve housing containing the valve member, and a lever coupled to the valve member for moving the valve member between the open and closed positions. Alternatively, the flow diverter may be configured as a dial that can be turned by the fingers of a user.

The fluid regulator may further comprise a recirculating passage for recirculating some fluid of the fluid stream near the outlet to the fluid collection chamber. The recirculating passage may be of any suitable size, shape and construction. Such a passage would allow mixing of some fluid of the fluid stream with any fluid located within the fluid collection chamber.

The fluid regulator may further comprise a bleeder passage for bleeding some of the fluid of the incoming fluid stream to the outlet whilst the fluid diverter is in the closed position. The bleeder passage may be of any suitable size, shape and construction. Such a passage would allow a user of the regulator to determine whether or not the incoming fluid was of adequate temperature, before moving the fluid diverter to the open position.

The recirculating passage and bleeder passage may be completely independent of one another or not.

The regulator may include an inlet valve associated with the flow passage and moveable between an open position for allowing the fluid stream into the flow passage and a closed position in which the fluid stream may not pass through the flow passage. Any suitable type of valve may be used. The inlet valve may be manually or automatically operated. Preferably, the inlet valve is a ball valve. The regulator may include a lever operably connected to the inlet valve, for moving the inlet valve between open and closed positions. Preferably, the lever is located below the body and a shaft connects the lever to the inlet valve. The shaft may extend through the body or externally of the body.

The regulator may include a flow controller for controlling the rate of flow of fluid from the collection chamber to the flow passage. Any suitable type of flow controller may be used. Preferably, the flow controller is a valve, such as a butterfly valve having an aperture therein. Such a valve may move to an open position when fluid is introduced into the chamber and the valve may move to a closed position when fluid is being drawn from the chamber, with fluid only being able to pass through the aperture in the valve.

According to a second aspect of the invention, there is provided a method for regulating the flow of a fluid stream from an outlet of a fluid supply line, said method comprising the steps of:

allowing a fluid stream to flow through a fluid supply line having an outlet;

collecting an initial volume of fluid from the fluid stream that lacks a desired characteristic, before the fluid stream can exit the outlet; and reintroducing the initial volume of fluid to the fluid stream when the fluid stream has the desired characteristic, wherein reintroduction of the initial volume of fluid is at such a rate that the desired characteristic of the fluid stream remains substantially unchanged.

Any suitable type of fluid stream may be regulated, but preferably the fluid is a liquid, such as water.

The desired characteristic is preferably temperature, but it could be another changing characteristic of the fluid stream, eg. fluid stream consistency. That is, the initial volume of fluid is of an undesirable temperature and is gradually reintroduced into the fluid steam when that fluid stream has reached the desired temperature, for, say, showering or bathing purposes.

Preferably, the fluid supply line is a hot and cold water supply line for a shower. Collection of the initial volume of fluid preferably occurs downstream of mixing valves for the shower (i.e. hot and cold water taps).

The method according to the second aspect of the invention may be carried out by the fluid regulator according to the first aspect of the invention.

The fluid regulator may be used to introduce one or more substances into the fluid stream and this may be achieved in any suitable way. In one embodiment, the fluid collection chamber contains one or more chemical substances, in the form of powders or liquids for example, and these are initially mixed with the fluid stream when the fluid diverter is in the closed position and released from the collection chamber when the fluid diverter is in the open position.

Thus, the instant invention also relates to a fluid regulator and its use for modifying a fluid stream. Such use may be important, for example, in the agricultural industry whereby chemicals need to be mixed with a water stream.

Preferred embodiments of the invention will now be described, by way of example, with reference to the accompanying figures.

DESCRIPTION OF THE PREFERRED EMBODIMENTS

Figure 1:
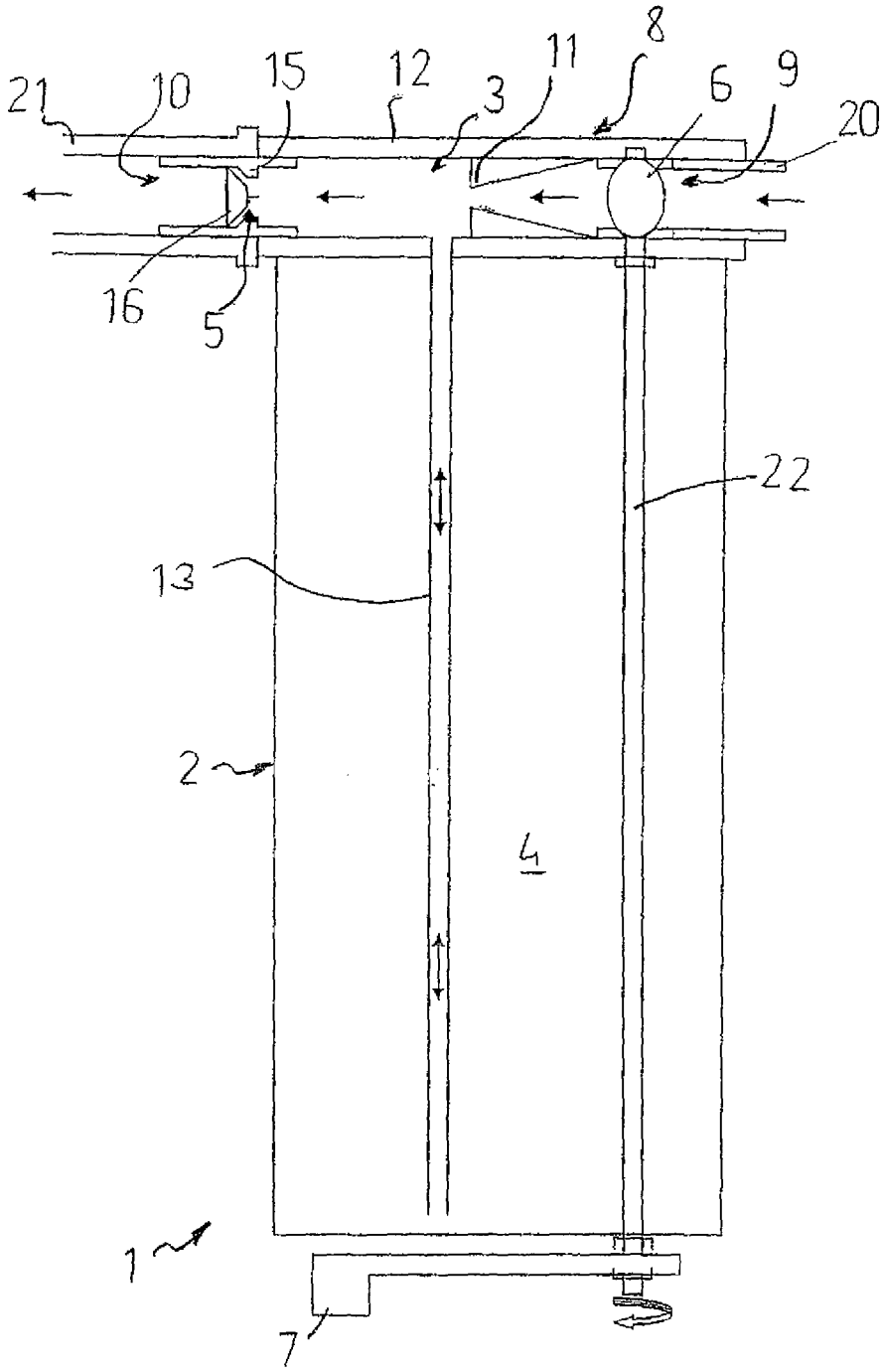
FIG. 1 is a cross-sectional view of a fluid regulator according to a first embodiment of the present invention.

In the figures, like reference numerals refer to like features.

Referring first to FIG. 1, there is shown a fluid regulator 1 having a body 2, a flow passage 3, a fluid collection chamber 4, a flow diverter 5, and an inlet valve 6 operably connected to a lever 7.

Figure 3:
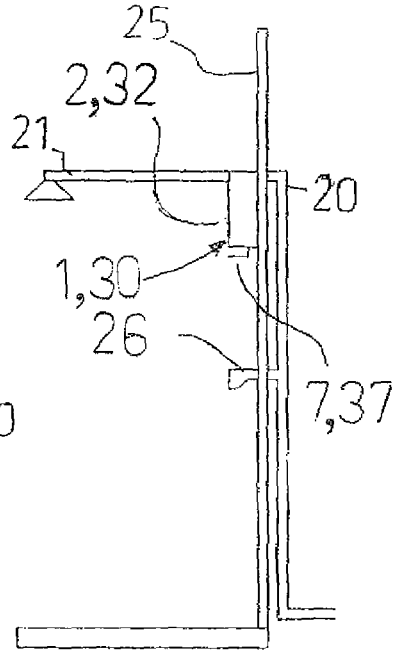
FIG. 3 depicts the fluid regulator of FIG. 1 or FIG. 2 installed in a shower recess, according to an embodiment of the present invention.

The body 2 has an upper region 8 in the form of a lid that is detachable from a lower region of the body 2. The body 2 is cylindrical, as seen in FIG. 3. The body is made of injection moulded plastics material or metal.

The flow passage 3 extends lineally through the upper region 8 of the body 2. An inlet 9 is located at one end of the flow passage 3 and an outlet 10 is located at the other end of the flow passage. The flow passage 3 has a constriction/throat 11 intermediate the inlet 9 and outlet 10.

The chamber 4 is located within the lower region of the body 2 and is in fluid communication with the flow passage 3 by way of a conduit 13. The conduit 13 meets the flow passage 3 at a point downstream of the constriction 11.

The flow diverter 5 comprises a jumper valve having a valve seat 15 and a sealing member 16 biased into engagement with the valve seat 15 by way of a spring (not shown). The flow diverter 5 is pressure sensitive and in the closed position diverts fluid to the collection chamber 4 and in the open position allows fluid to exit the outlet 10.

Valve 6 is operably coupled to the lever 7 by way of a shaft 22 and the shaft extends longitudinally through the body 2. The lever 7 enables the ball valve 6 to be moved between an open position and a closed position. In the closed position, fluid is unable to flow through the flow passage 3.

The flow passage inlet 9 is threaded and is attachable to a threaded end of a fluid supply pipe 20. The outlet 10 is also threaded and is attachable to a threaded end of an outlet pipe 21, such as a shower rose/head.

As seen in FIG. 3, the regulator 1 is mountable to a shower recess wall 25 between a shower rose 21 and hot and cold tap mixing valves 26 that control the flow of fluid through the fluid supply pipe 20.

Figure 2:
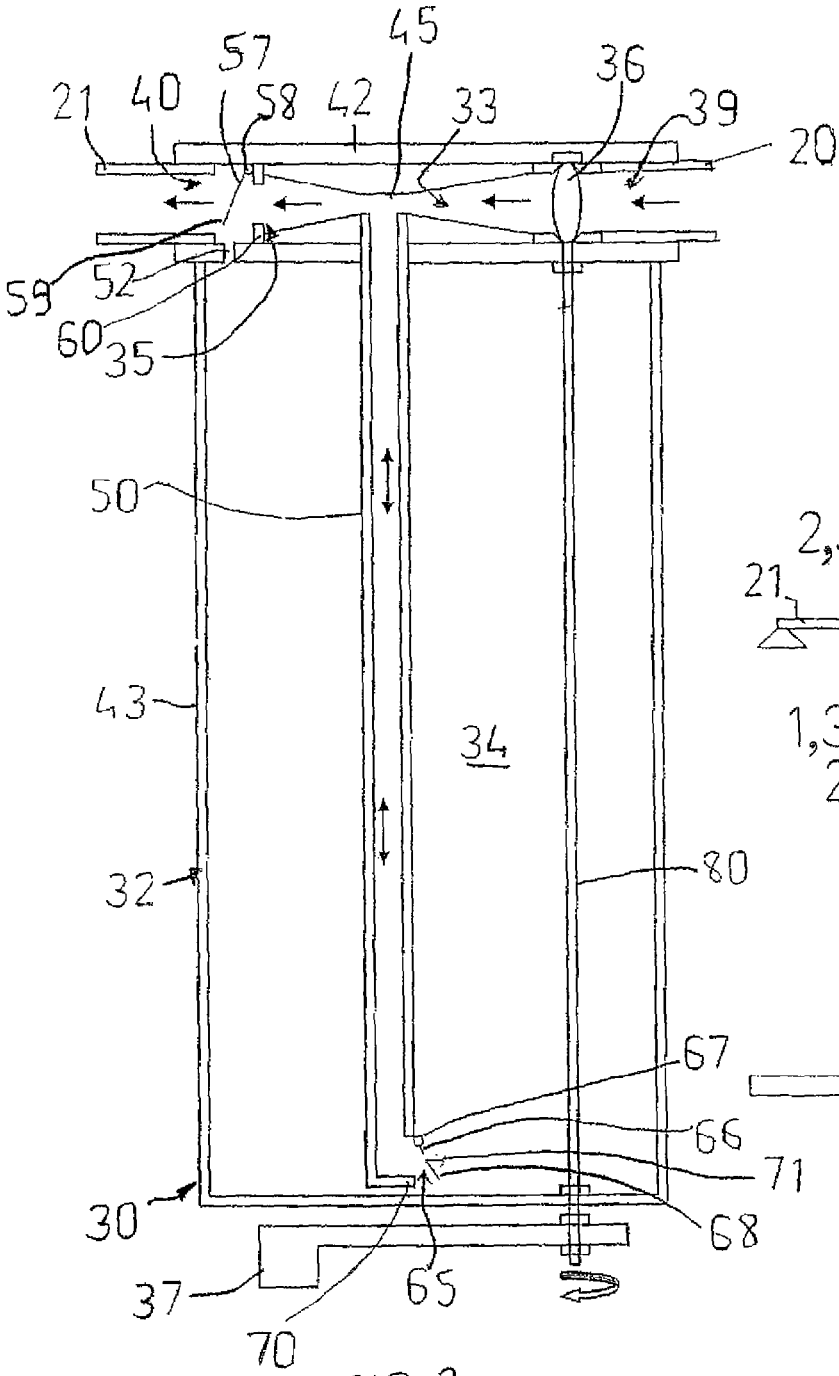
FIG. 2 is a cross-sectional view of a fluid regulator according to a second embodiment of the present invention.

Referring now to FIG. 2, there is shown a fluid regulator 30 according to another embodiment of the invention.

The regulator 30 has a body 32, a flow passage 33, a collection chamber 34, a flow diverter 35, and an inlet valve 36 operably connected to a lever 37.

The body 32 has an upper region 42 in the form of a lid that is detachable from a lower region 43 of the body 32.

The flow passage 33 has an inlet 39 at one end of the flow passage 33 and an outlet 40 at the other end of the flow passage 33. The flow passage 33 has a constriction/throat 45 that is used to produce a Venturi effect.

The chamber 34 is located within the lower region 43 of the body 30 and is in fluid communication with the flow passage 33 by way of a conduit 50. The conduit 50 meets the flow passage 33 at the constriction 45.

The chamber of 34 has a vent 52 for introducing air from the flow passage 33 into the chamber 34 and to vent air from chamber 34 whilst filling.

The flow diverter 35 is a magnetically sealed and pressure sensitive butterfly valve. The butterfly valve has a wing 57 that can be magnetically connected to a valve seat 60. One end of the wing 57 is hingedly connected to an upper part of the flow passage 33 or valve seat 60, and the other end of the wing 59 can move into and out of contact with a lower part of the valve seat 60. In the contact (closed) position, the fluid stream within the flow passage 33 is diverted to the chamber 34. In the open position, the fluid steam can exit the outlet 40.

The inlet 39 of the flow passage 33 is threaded and is attachable to a threaded end of a fluid supply pipe 20. The outlet 40 is also threaded and attachable to a threaded end of an outlet pipe 21, say, a shower rose/head.

Ball valve 36 is operably coupled to the lever 37 by way of a shaft 80 and the shaft 80 extends longitudinally through the body 32. The lever 37 enables the ball valve 36 to be moved between an open position and a closed position. In the closed position, fluid is unable to flow through the flow passage 33.

The regulator 30 also has a flow controller valve 65 located at a chamber end of the conduit 50. The valve 65 is a butterfly valve having a wing 66 and an end 67 of the wing 66 is hingedly connected to the conduit 50. Another end 68 of the wing 66 can move between an open position and a closed position. In the closed position the end 68 is in contact with an end 70 of conduit 50. In the open position the end 68 is not in contact with end 70. The wing 66 has an opening 71 through which fluid can flow at a constant rate when the valve 65 is in the closed position.

The regulator 30 can be installed, for example, in a shower recess as described for regulator 1 and as depicted in FIG. 3.

In use, the ball valve 6, 36 is moved to the open position and the flow diverter 5, 35 is in the closed position. Fluid flowing through the inlets 9, 39 is diverted by the flow diverter 5, 35 into the chamber 4, 34 by way of the conduit 13, 50. For regulator 30, butterfly valve 65 moves to the open position whilst fluid enters the chamber 34 and then moves to the closed position once fluid has completely filled the chamber 34.

After the collection chamber 4, 34 has completely filled with fluid (usually after about 7 seconds), the fluid pressure within the flow passage 3, 33 causes the flow diverter 5, 35 to move to the open position—that is, for regulator 1, sealing member 16 disengages the valve seat 15 and, for regulator 30, the wing 57 pivots out of magnetic engagement with the valve seat 60. As fluid flows through the flow passage 3, 33 and through the outlet 10, 40, the constriction 11, 45 produces a Venturi effect and fluid is drawn from the chamber 4, 34 into the flow passage 3, 33 by way of conduit 13, 50. For regulator 30, the valve 65 is in the closed position and the rate of fluid flow from the chamber 34 is determined by the opening 71 in the wing 66. Also, the vent 52 enables air to enter the chamber 34 as fluid is displaced therefrom.

The regulator 1, 30 can be used as a water saving device wherein an initial volume of the water at an undesired temperature is collected in the chamber 4, 34 and is reintroduced into the fluid stream when the fluid stream has reached the desired temperature. Reintroduction of the initial volume of water is at a controlled rate such that the temperature change upon reintroduction is not significant. When the chamber 4, 34 has been emptied of water (usually after about 6 minutes) then air is introduced into the fluid stream in the flow passage 3, 33. This results in a noticeable change in flow rate of the fluid stream, and signifies to a user of the shower that showering time has come to an end and that it is time to dry off with a towel.

Rather than turning off the mixing valves 26 (hot and cold water taps), the user closes the ball valve 6, 36 using the lever 7, 37. In this way, the mixing valves 26 need not be adjusted for the next shower.

Figure 4:
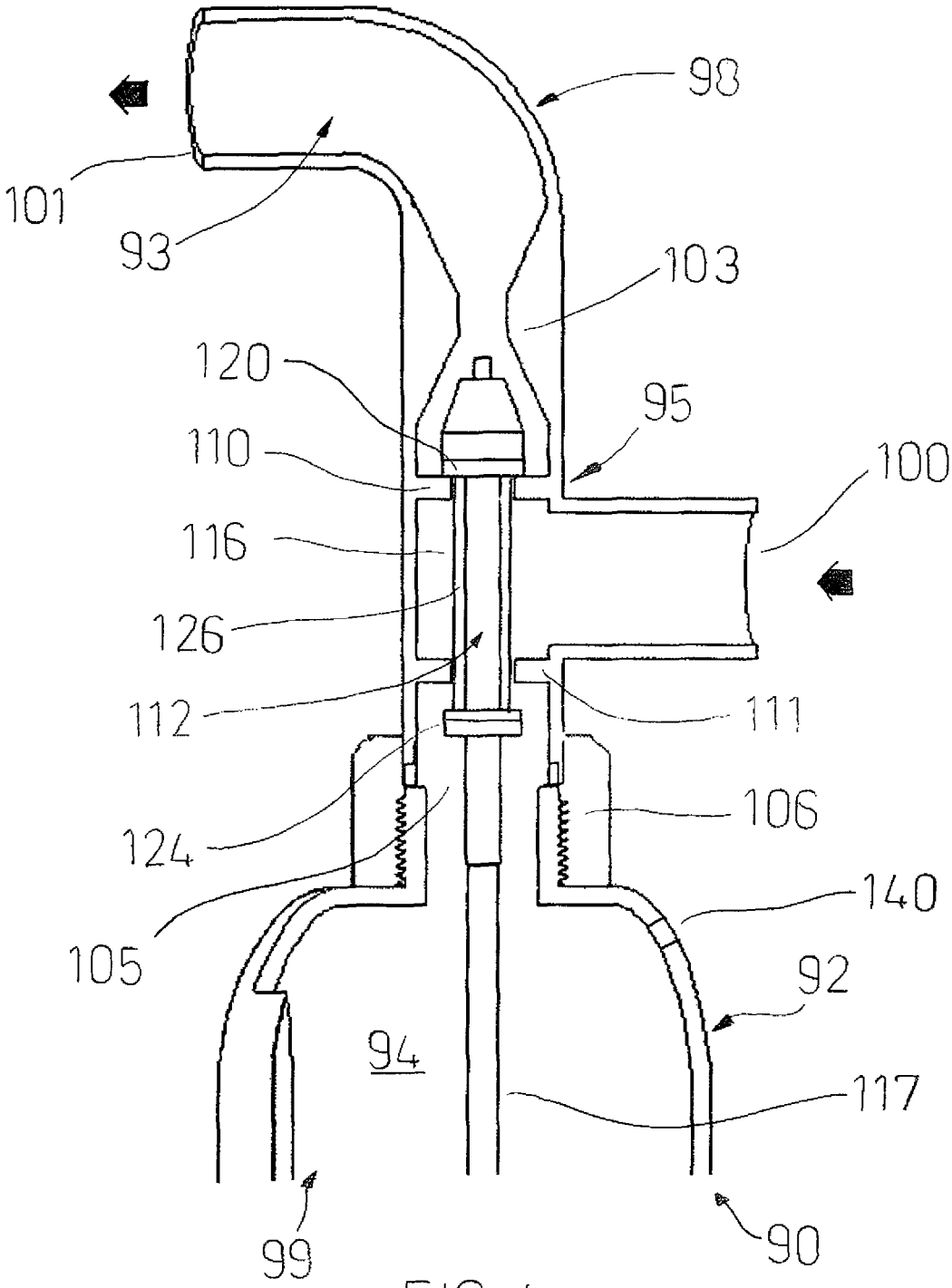
FIG. 4 is a sectional perspective view of a fluid regulator according to a third embodiment of the present invention, with the figure indicating the direction of fluid flow through the fluid regulator.
Figure 6:
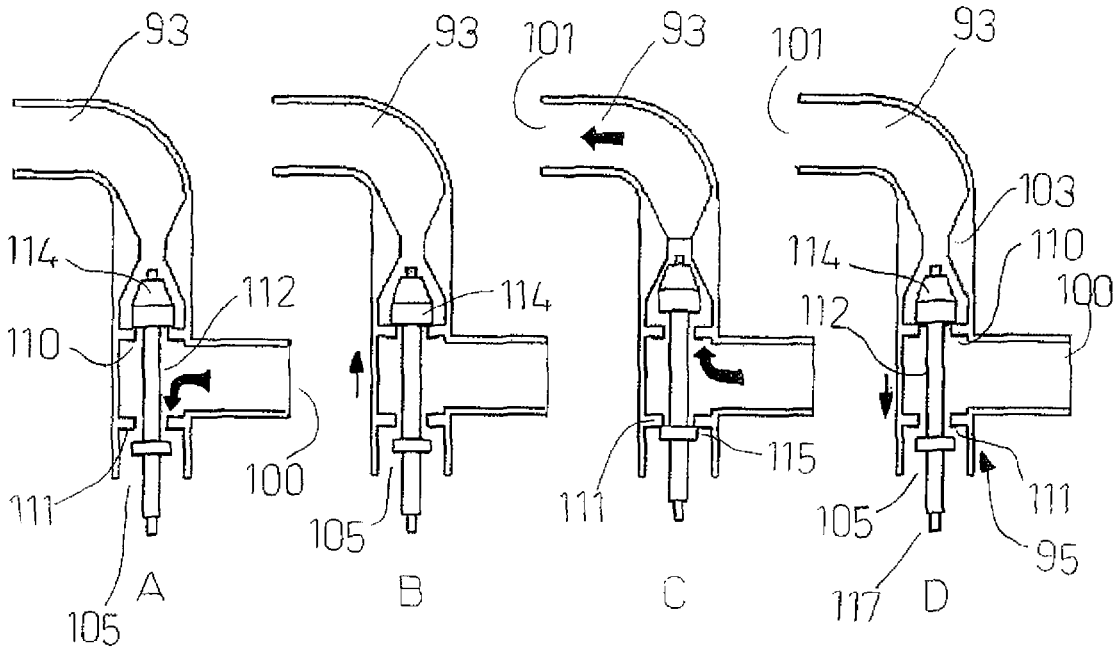
FIGS. 6 A to D show how the regulator valve member of FIG. 5 diverts fluid flow through the fluid regulator.
Figure 5:
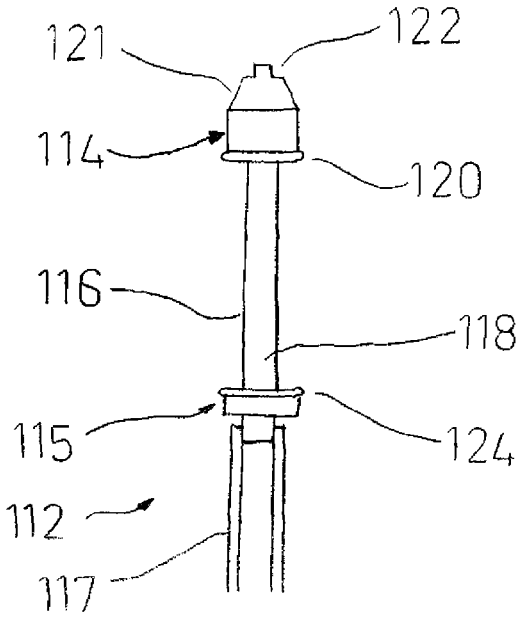
FIG. 5 is a detailed side elevation view of part of a regulator valve member of the fluid regulator shown in FIG. 4.

Referring now to FIGS. 4-6, there is shown part of a fluid regulator 90 according to a further embodiment of the invention. The regulator 90 has a body 92, a flow passage 93, a fluid collection chamber 94 and a flow diverter 95. The regulator 90 also has an inlet valve and lever like inlet valve 6 and lever 7 (not shown).

As seen in FIG. 4, the body 92 has an upper region 98 in the form of a branched conduit 98 and a lower region 99 in the form of a container 99. The body 92 is made of injection moulded plastics material and/or metal.

The flow passage 93 is provided by the branched conduit 98 of the body 2. An inlet 100 is located at one end of the flow passage 93 and an outlet 101 is located at the other end of the flow passage 93. The flow passage 93 has a constriction/throat 103 intermediate the inlet 100 and outlet 101. The branched conduit 98 has a conduit section providing another end 105 that is adjacent to inlet 100, and end 105 is connected to a neck 106 of the container 99.

The chamber 94 is provided by the container 94 of the body 92 and is in fluid communication with the flow passage 93 by way of end of 105. End 105 provides an inlet 105 to the chamber 94 and is located upstream of the constriction/throat 103.

The chamber 94 has a vent 140 for introducing air into the chamber 94 and to vent air from chamber 94 whilst being filled with fluid.

As described for regulators 1 and 30, regulator 90 is mountable to a shower recess wall between a shower rose and hot and cold tap mixing valves that control the flow of fluid to the inlet 100.

The flow diverter 95 is pressure sensitive and in a closed position diverts the fluid stream to the chamber 94, and in an open position allows the fluid stream to exit via outlet 101.

The flow diverter 95 includes a first valve seat 110 extending across the flow passage 93, a second valve seat 111 extending across the collection chamber inlet/end 105, and a regulator valve member 112 movable by the fluid stream between the valve seats 110, 111.

As seen in FIG. 5, the regulator valve member 112 has a head 114, a tail 115, a stem 116, a passage 118 and a drainage tube 117.

The head 114 has a disk-shaped lower portion for sealing a central opening of the first valve seat 110. An o-ring 120 extends within a peripheral groove of the disk-shaped portion. The head 114 has a tapered upper portion 121 and a tip 122 that are situated adjacent the constriction/throat 103 of the flow passage 93.

The tail 115 has a disk-shaped portion so as to seal a central opening of the second valve seat 111. An o-ring 124 extends within a peripheral groove of the disk-shaped portion.

The stem 116 extends along a longitudinal axis of the valve member 112 between the head 114 and tail 115, and the stem 116 extends slidingly through both the first and second valve seats 110, 111. The stem 116 has longitudinally extending grooves 126 (omitted from FIGS. 5 and 6) enabling the flow of fluid between the stem 116 and each valve seat 110, 111. The passage 118 extends from the tail 115 to the tip 122 of the head 114 and can communicate fluid from the chamber 94 to the flow passage 93.

The drainage tube 117 is made of silicone and extends from an end of the tail 115 to a base of the chamber 94.

The valve member 112 is biased, by way of gravity, such that the head 114 will engage and seal the first valve seat 110 in the absence of a fluid stream. The valve member 112 can only sealingly engage one of the valve seats 110, 111 at any given time. That is, when the head 114 engages and seals the first valve seat 110, then the tail 115 cannot engage and seal the second valve seat 111.

In use, the inlet valve is opened and the flow diverter 95 is in the closed position. Fluid flowing through the inlet 100 is diverted by the flow diverter 95 to the chamber 94 by way of chamber inlet 105. That is, the head 114 engages the first valve seat 110 and fluid is diverted to the chamber 94 between the stem 116 and the second valve seat 111. This is shown in FIG. 6 A.

After the chamber 94 has filled with fluid, the fluid pressure within the flow passage 93 causes the flow diverter 95 to move upwardly to the open position. This is shown in FIGS. 6 B and C. When the chamber 94 fills with fluid, the tail 115 is forced into engagement with the second valve seat 111 and fluid within the chamber 94 drains to the outlet 101 by way of the drainage tube 117 and passage 118. A Venturi effect causes the fluid to be drawn up through the drainage tube 117 and passage 118. This is shown in FIG. 6 C. Also, with the head 114 displaced from the first valve seat 110, fluid entering the inlet 100 will flow between the stem 116 and the first valve seat 110 and mix with fluid exiting passage 118. In this way, fluid of unsuitable temperature that has been collected in chamber 94 will mix with fluid of the desired temperature prior to leaving the flow passage 93.

The regulator valve member 112 is maintained in the open position by three forces, namely: (1) momentum transfer from the fluid stream as fluid flows around the disk-shaped lower portion of the head 114; (2) an upwards force vector due to a pressure drop when fluid passes between the tapered upper portion 121 and the constriction/throat 103; and (3) the Venturi effect, which provides a low pressure region directly above the head 114. In the absence of a fluid stream, the regulator valve member 112 will drop and the flow diverter 95 will resume the closed position, as shown in FIG. 6 D.

Referring now to FIGS. 7-10, there is shown part of a fluid regulator 200 according to a further embodiment of the invention. The regulator 200 has a body 210, a flow passage 220, a fluid collection chamber 230 and a flow diverter 240.

The body 210 has an upper region 211 generally in the form of a branched (T-shaped) conduit 211 and a lower region 212 generally in the form of a container 212. The body 210 is made of injection moulded plastics material and/or metal.

The flow passage 220 is provided in part by the branched conduit 211 as well as by the flow diverter 240. A threaded inlet 221 is located at one end of the flow passage 220 and a threaded outlet 222 is located at the other end of the flow passage 220. The flow passage 220 has a constriction/throat 223 intermediate the inlet 221 and outlet 222 for providing a Venturi effect. The branched conduit 211 has a conduit section providing another end 215 that is intermediate the inlet 221 and outlet 222, and end 215 is connected to a threaded neck 216 of the container 212 by way of a threaded cap 217.

The inlet 221 is attachable to a threaded end of a fluid supply pipe (not shown). The outlet 222 is attachable to a threaded end of an outlet pipe, say, a shower rose/head (not shown).

The chamber 230 is provided by the container 212 and is in fluid communication with the flow passage 220 by way of a conduit 236. End 215 provides an inlet 235 to the chamber 230. The chamber 230 has a vent 231 for introducing air into the chamber 230 and to vent air from chamber 230 whilst being filled with fluid via conduit 236.

As described for regulators 1 and 30, regulator 200 is mountable to a shower recess wall between a shower rose and hot and cold tap mixing valves that control the flow of fluid to the inlet 221. In this regard, the upper region 211 of the body 210 has the threaded inlet 221 as well as a wall-mounting flange 219.

The flow diverter 240 comprises a ball valve 241, a valve housing 244 containing the ball valve 241 that extends laterally of the upper region 211 of the body 210, and a hand-operable lever 242 extending laterally of the valve housing 244.

There is a void 270 between the housing 244 and the ball valve 241. The valve housing 244 has three major openings and bushes/seals 260, 261, 262, each of which sealingly engage the ball valve 241. The lever 242 sealingly extends from the ball valve 241 through another opening in the housing 244 and can be used to rotate the ball valve 241 between open and closed positions.

The ball valve 241 contains the constriction/throat 223 of the flow passage 220 and a short passage 277 extending laterally thereof. The passages 220, 277 of the ball valve 241 rotate with the lever 242 in spaced parallel planes. In the closed position the fluid stream is diverted to the chamber 230 via conduit 236, and in the open position the fluid stream is directed to the outlet 222 also via conduit 236.

Figure 8:
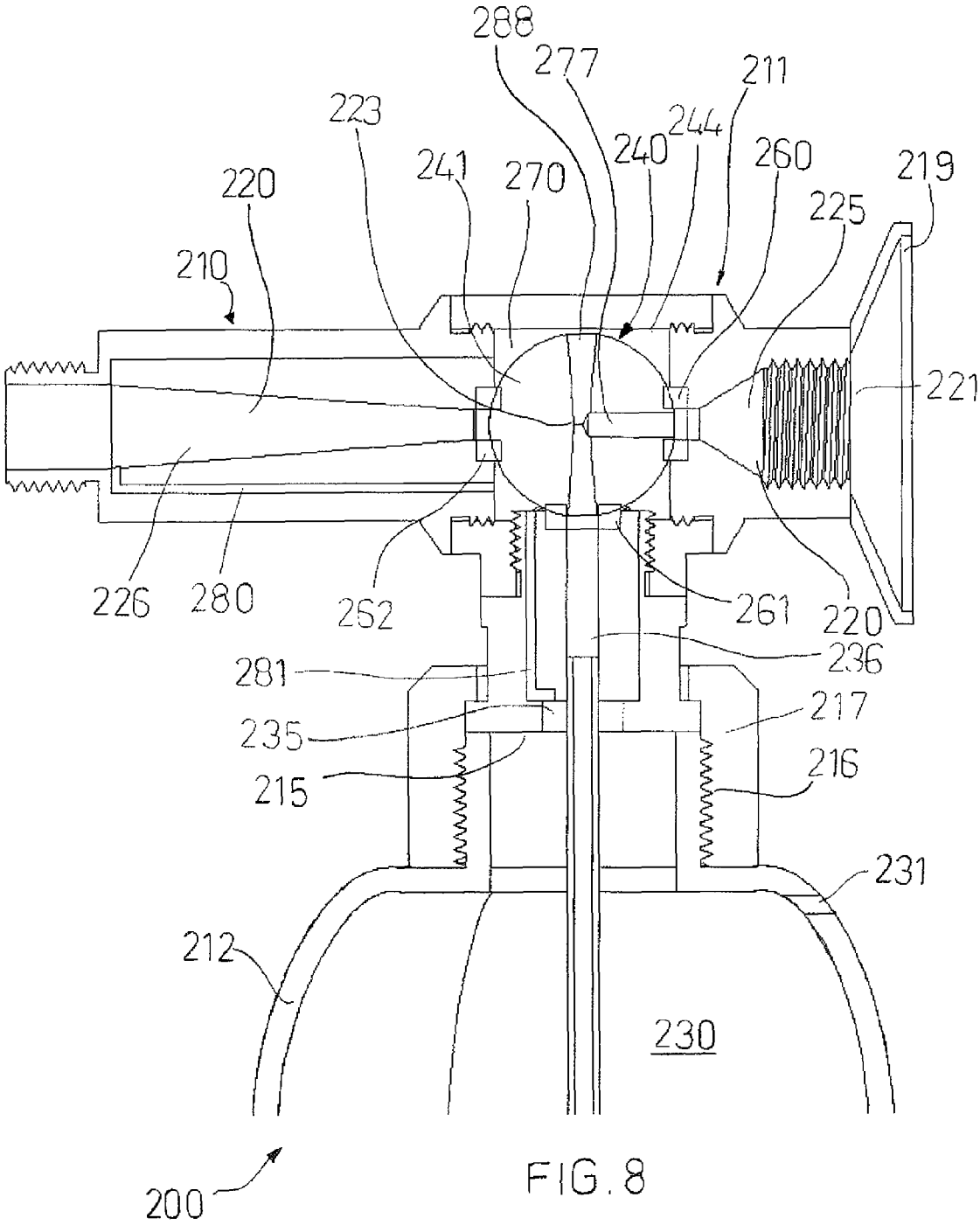
FIG. 8 is an enlarged view of that shown in FIG. 7, showing a flow diverter of the regulator in a closed position.

As seen in FIG. 8, a pressure-increasing section 225 of the flow passage 220, extending between the inlet 221 and ball valve 241, converges at bush 260. A pressure-diffusing section 226 of the flow passage 220, extending between the outlet 222 and the ball valve 241, converges at bush 262. Conduit 236 extends from the chamber 230 to bush 261.

The fluid regulator 200 has a recirculating passage for recirculating some fluid of the fluid stream near the outlet 222 to the collection chamber 230. The recirculating passage is formed by void 270, a passage 280 extending between the void 270 and the pressure-diffusing section 226 of the flow passage 220, and another passage 281 extending between the void 270 and container inlet 235.

The fluid regulator 200 has a bleeder passage for bleeding some of the incoming fluid to the outlet 222 whilst the fluid diverter 240 is in the closed position. The bleeder passage is formed by a section 288 of flow passage 220 contained within the ball valve 241, void 270 and passage 280 (see FIG. 8). Such a passage enables a user of the regulator 200 to determine whether or not the incoming fluid is of adequate temperature, before moving the fluid diverter 240 to the open position.

Figure 7:
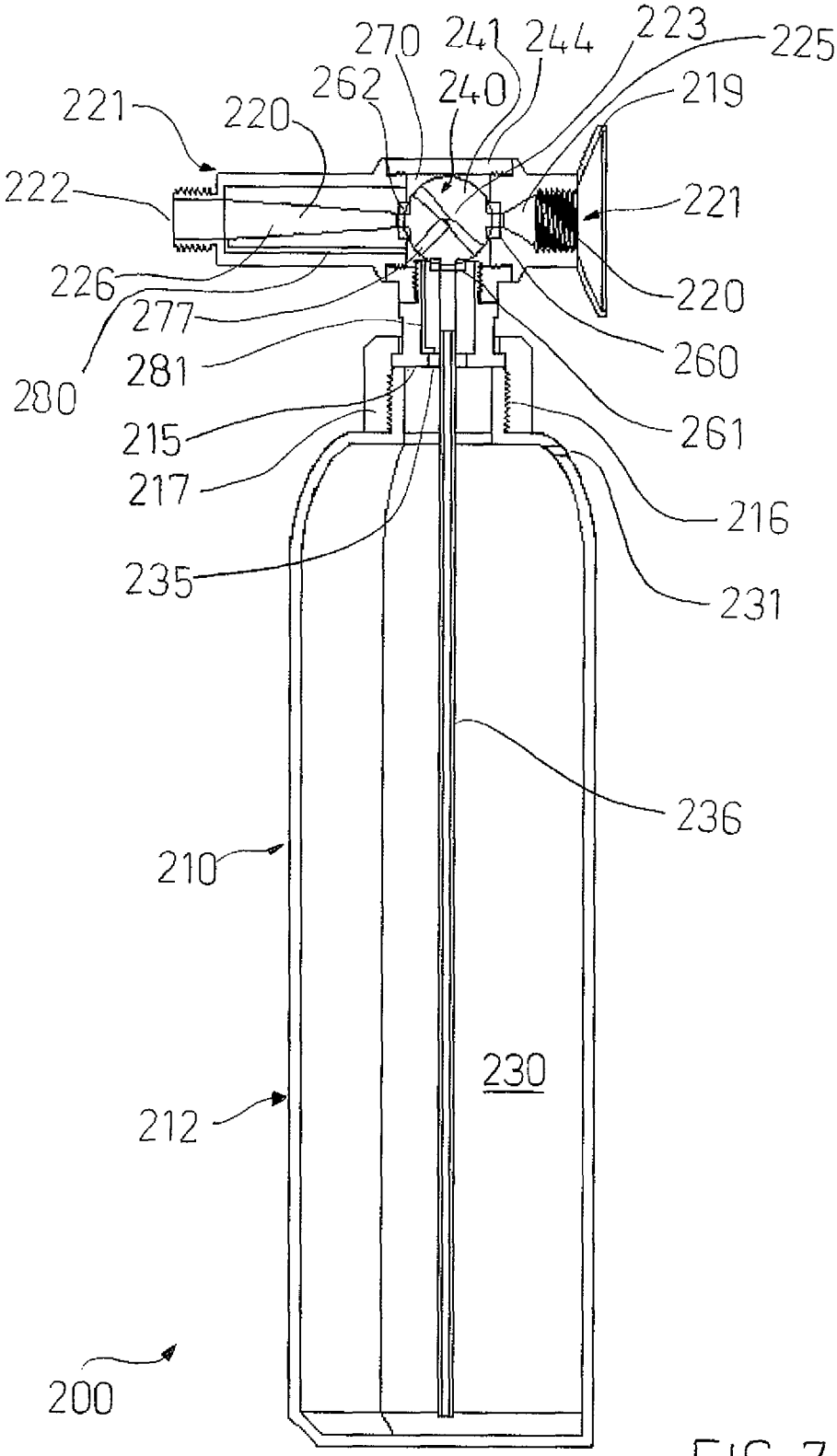
FIG. 7 is a cross-sectional view of a fluid regulator according to a third embodiment of the present invention, showing a flow diverter of the regulator in a fully closed position.

As seen in FIG. 7, the upper region 211 of the body 210 comprises various threaded pieces that sealingly connect together. Such pieces have not been labelled.

When the fluid regulator 200 is initially mounted to a shower recess, a user moves the fluid diverter 240 to the fully closed position, as seen in FIG. 7, by turning lever 242. The user then opens the hot and cold mixing taps.

Next, the lever 242 is used to rotate ball valve 241 to the closed position, as shown in FIG. 8. In that position, water flowing through the inlet 221 converges at constriction 223 and collects within chamber 230 via conduit 236. A small quantity of incoming water nevertheless escapes the outlet 222 via constriction 223, void 270 and bleeder passage 280. Whilst filling, air is evacuated from the chamber 230 via vent 231.

When the user initially turns on the hot and cold mixing taps, there is an appreciable lag before the water attains a usable temperature. Therefore, the water entering the chamber 230 will generally be colder than the temperature desired by the user. Water escaping the outlet 222 via the bleeder passage enables the user to monitor the temperature of the incoming water.

The chamber 230 is transparent. This allows the user to see how much fluid has been collected in or removed from the chamber 230. This places water consumption at the forefront of the user's mind.

Figure 9:
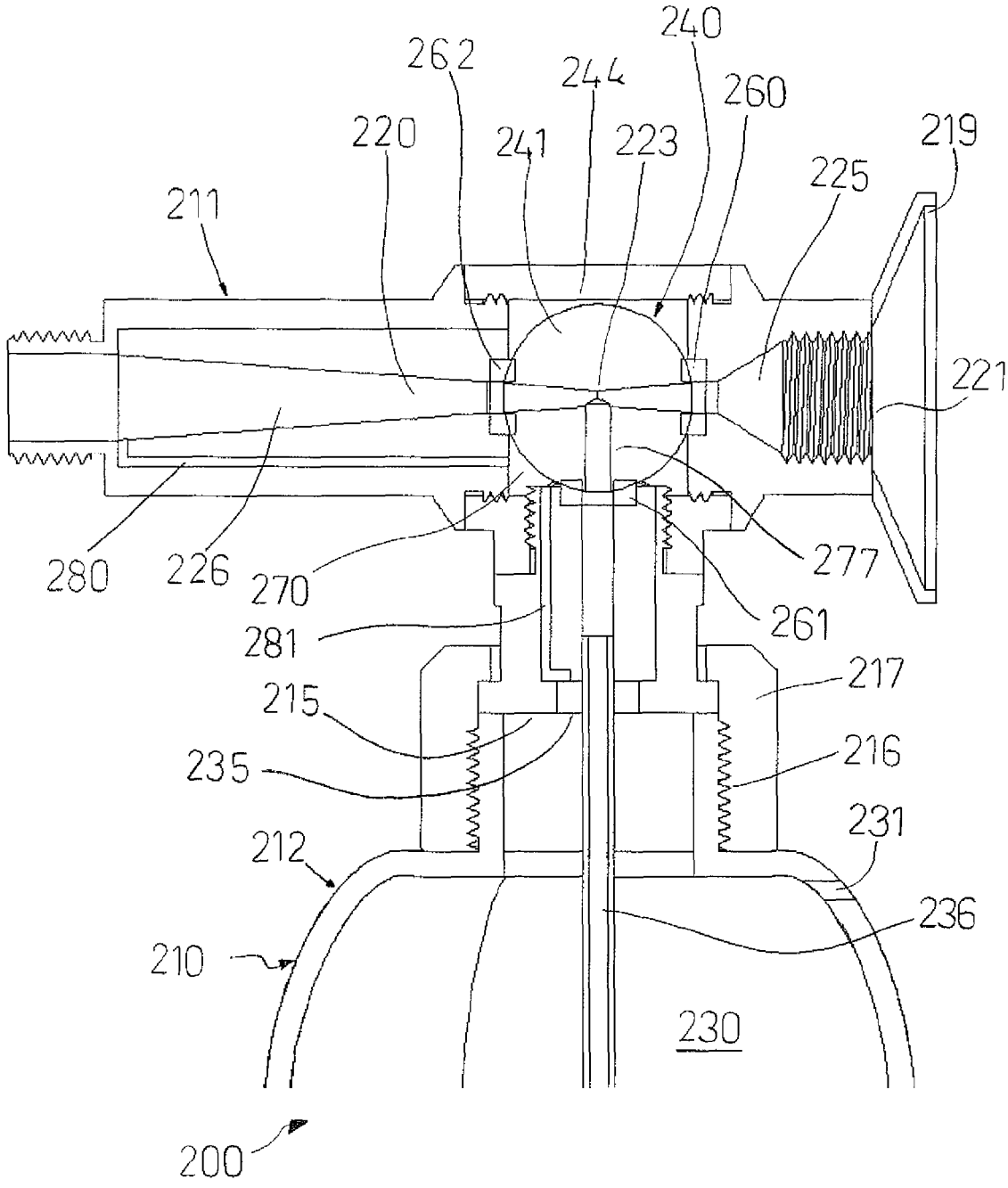
FIG. 9 is an enlarged view of that shown in FIG. 7, showing the flow diverter of the regulator in an open position.
Figure 10:
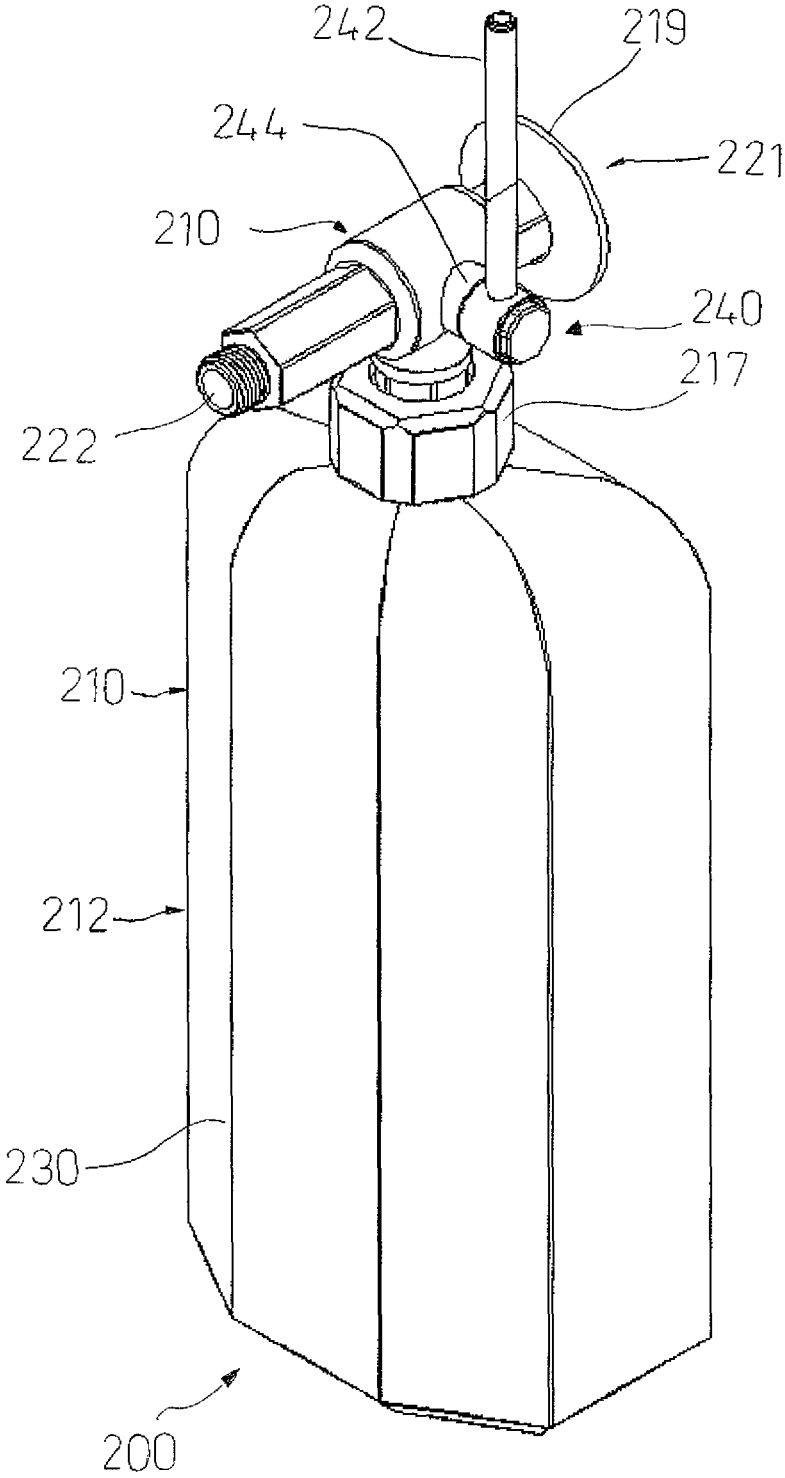
FIG. 10 is a perspective view of the fluid regulator shown in FIG. 7.

When the incoming water is of suitable temperature and the chamber 230 has been adjudged by the user to have been filled to a suitable level, the user then rotates the ball valve 241 to the open position as seen in FIG. 9. In the open position, warmer water flowing to the outlet 222 via the constriction/throat 223 creates a Venturi effect, thus drawing cooler water out of chamber 230 via conduit 236. The warmer and cooler water streams mix to the desired temperature and attain the desired pressure before leaving the outlet 220

Whilst water is drawn out of the chamber 230, air enters the chamber 230 via vent 231 and a small amount of water is diverted to the chamber 230 via the recirculation passage.

When the water is completely drawn from the chamber 230, air is taken up by the conduit 236 and introduced into the water stream. This causes the water stream exiting the outlet 222 to become slightly aerated, which signals the user that it is time to finish the shower.

When the user decides to end the shower the lever 242 is again turned such that the ball valve 241 attains the fully closed position as shown in FIG. 7. In this position, the user need not shut off the mixing taps.

It is estimated that if the regulator 1, 30, 90, 200 were to be fitted to every shower in Australia, a minimum of 20 million liters of potable water would be saved per day. This reduction in potable water usage would therefore be both environmentally and financially advantageous.

Other advantages of the present invention include that:

It is easy to use.

In some embodiments, it is fully automatic.

It does not require an external source of power.

It is easy to install.

It is essentially maintenance free.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

The invention claimed is:

1. A fluid regulator for regulating the flow of a fluid stream, said regulator comprising:

a body;

a flow passage extending through the body and having an inlet for a fluid stream originating from both hot and cold sources of fluid and an outlet for the fluid stream;

a fluid collection chamber within the body in fluid communication with the flow passage by way of a conduit that extends into the collection chamber, said fluid collection chamber having a vent that always remains open to atmospheric pressure; and a flow diverter associated with the flow passage and moveable between a closed position in which the fluid stream is directed to the collection chamber by way of the conduit, and an open position in which the fluid stream may flow to the outlet and the fluid in the collection chamber may be drawn from the collection chamber to the outlet by way of the conduit and the flow passage so as to substantially empty the collection chamber;

a recirculating passage for recirculating some fluid of the fluid stream near the outlet to the fluid collection chamber, said recirculating passage remains in constant fluid communication with the collection chamber regardless of whether the flow diverter is in the open or closed position; and a bleeder passage for bleeding some fluid of the incoming fluid stream to the outlet whilst the fluid diverter is in the closed position, wherein the flow passage has a constriction located between the inlet and the outlet, said constriction causing fluid to be drawn from the collection chamber into the flow passage by way of a Venturi effect when the flow diverter is in the open position.

2. The fluid regulator of claim 1, wherein the inlet is attachable to a fluid supply line and the outlet is attachable to a shower rose.

3. The fluid regulator of claim 1, wherein the collection chamber is sized to collect between 1 to 20 liters of fluid.

4. The fluid regulator of claim 1, wherein the flow diverter comprises a valve member movable relative to the body of the regulator, the valve member containing a section of the flow passage that is in fluid communication with the fluid collection chamber.

5. The fluid regulator of claim 4, wherein the flow diverter further comprises a valve housing containing the valve member, and a lever coupled to the valve member for moving the valve member between the open and closed positions.

6. The fluid regulator of claim 4, wherein the valve member is a ball valve.

7. The fluid regulator of claim 1, wherein the collection chamber is transparent or translucent so as to allow visualization of its contents.

* * * * *